United States Patent [19]

Braun

[11] Patent Number: 4,685,192

[45] Date of Patent: Aug. 11, 1987

[54] APPLIANCE FOR REMOVAL OF BURRS ON FLAME-CUT SLABS; BLOOMS AND BILLETS

[76] Inventor: Ernst P. Braun, 3, Berliner Str., Dillingen/Saar, Fed. Rep. of Germany, 6638

[21] Appl. No.: 788,472

[22] Filed: Oct. 17, 1985

[30] Foreign Application Priority Data

Oct. 17, 1984 [DE] Fed. Rep. of Germany ..... 3438010

[51] Int. Cl.[4] ..... B21P 1/46

[52] U.S. Cl. ..... 29/526.4; 173/39

[58] Field of Search ..... 173/39, 42; 15/236 R, 15/242; 72/39, 203, 204; 29/DIG. 52, DIG. 7, DIG. 34, 526.4, 526.2, 526.6, 527.6

[56] References Cited

U.S. PATENT DOCUMENTS 1,966,446 7/1934 Hayes ..... 29/DIG. 52

*Primary Examiner*—E. R. Kazenske
*Assistant Examiner*—Willmon Fridie, Jr.
*Attorney, Agent, or Firm*—Holman & Stern

[57] ABSTRACT

Burrs on flame-cut semi-products are removed with the aid of a transversely guided flat chisel driven pulsatingly by a pneumatic percussion device, which reduces the advance forces required. The inclination of the flat chisel may be varied during operation against a continuously effective force to permit the chisel edge to follow any uneven areas, e.g. cambers, which may be present on the product surface bearing the burr, and to cause the chisel edge to always engage between the product surface and the burr. A variable speed drive is used for relative advance movement between the chisel and the product, so that the advance speed is increased when a portion of the burr splits off and gives way during chisel operation.

18 Claims, 7 Drawing Figures

APPLIANCE FOR REMOVAL OF BURRS ON FLAME-CUT SLABS; BLOOMS AND BILLETS

BACKGROUND OF THE INVENTION

1. Field of the Invention

The invention relates to an appliance for the removal of burrs on flame-cut slabs, blooms and billets or like semi-finished products, having a cutting tool adjustable in the vertical plane, motion of which is relative to the semi-finished product and parallel to the cutting line.

2. Description of the Prior Art

Such an appliance has become known by from German Patent reference No. 28 49 208 which utilizes a cutting blade with a cutting edge positioned slantingly to the cutting line or burr. Relative to the fixed cutting blade, the semi-finished product resting on a roller table is moved forward to shear off the burr laterally with its cutting edge. Apart from the fact that such procedure requires high material feed forces and involves heavy wear on the cutting blade, such an appliance cannot perform satisfactorily on a product that is contorted or cambered, i.e. where the bottom product surface is not perfectly level.

BRIEF SUMMARY OF THE INVENTION

The object of the invention is to provide an appliance for mechanical removal of burrs in a manner that will permit the use of a lower powered drive for movement of the product in cases where the cutting tool is fixed or, for movement of the cutting tool where the product is at rest, and that will also permit reliable removal of burrs independent of the flatness of the product surface bearing the burr.

This object is achieved by the cutting tool of the invention which consists of a flat chisel designed to move at an angle to the product surface and is provided with a tapering chisel edge, and wherein the flat chisel is driven pulsatingly similar to a pneumatic percussion device and during operation the chisel is pressed against the product surface by a continuously effective force. The use of a slantingly guided pulsatingly driven flat chisel considerably reduces the power required for the removal of a burr as compared to the prior art, especially since vertical adjustment of the tapering chisel edge will permit said edge to be positioned to always engage between the product surface and the burr. The continuously effective force with which the flat chisel is pressed against the product surface during operation will let the chisel edge follow every camber on the surface of the product, ensuring reliable removal of the burr. Furthermore, since this method will always prevent the chisel edge from working into the extremely hard burr, wear on the cutting tool is reduced.

When the flat chisel and its pulsating drive is carried by a chisel holder which may be swivelled about the horizontal axle of a raising and lowering bearing block in a transverse direction to the product surface and when a preloaded spring or similar resilient power means is provided between the chisel holder and the bearing block in a manner that lifting motion of the bearing block and contact of the chisel edge with the product surface in conjunction with swivel motion of the chisel holder, its chisel and pulsating drive, will increase the tension of said relilient power means, the effect produced thereby is such that the flat chisel is forced against the product surface from a swivel movement about the horizontal swivel axle. The raising and lowering feature of the bearing block supporting the horizontal swivel axle permits vertical adjustment of the cutting tool, which is known as such, but which is also utilized to apply tension to the resilient power means that is to force the chisel edge against the product surface.

The bearing block supporting the flat chisel and its pulsating drive is advantageously designed to rotate about a vertical axle, firstly, to place the chisel edge in a slanting position to the relative advance motion for partial lateral engagement of the burr, second, to permit burrs to be removed not only along transverse but also along longitudinal cutting lines. The bearing block is therefore capable of rotating at least through 90° clockwise and counter-clockwise from a center position in which the burr of a separating cut may be removed transversely to the product.

Further embodiments of the invention relate to an inventive appliance for feed motion of the chisel as well as the product itself. According to a solution for the procedure in which the semi-finished product is at rest, a unit embracing the flat chisel is straight-guided in a guide frame and provided with an advance drive, the guide frame being further associated with a lifting device. Through its lifting device, the guide frame is preferably seated on a carriage designed to move transversely to the advance direction of the chisel, which will permit the entire appliance to be positioned at a right angle to the table roller axes. A particular advantage with respect to the operational velocity of the inventive appliance is gained from a layout feature of the chisel advance drive, in that the chisel is not moved at a constant advance speed but rather with a constant advance power generated by a pneumatic drive or rotary field magnet. In this manner, the unit supporting the flat chisel will advance at an increased speed when a length of the burr happens to split off during the removal procedure.

In addition to the solution covering a movable carriage for forward travel of the unit carrying the flat chisel, the invention also includes a solution which comprises a portal for straight guidance of the support type guide beam. The portal may also be designed to carry two supports moving in opposite directions and provided with inversely positioned chisels for removal of a burr from both ends.

With light-weight products it may be advisable to provide means that will prevent the product from yielding in the upward direction, since flame-cutting is usually performed with a downwardly directed flame causing the burr to form on the bottom surface of the product. This, however, should not rule out the solution of positioning the flat chisel at a downward slope to permit removal of a burr on the upward product surface.

BRIEF DESCRIPTION OF THE DRAWINGS

An exemplary embodiment of the invention will now be described in detail with reference to the accompanying drawing, with an appliance for removal of a burr on the lower surface of the semi-finished product, wherein.

DETAILED DESCRIPTION

Figure 1A:
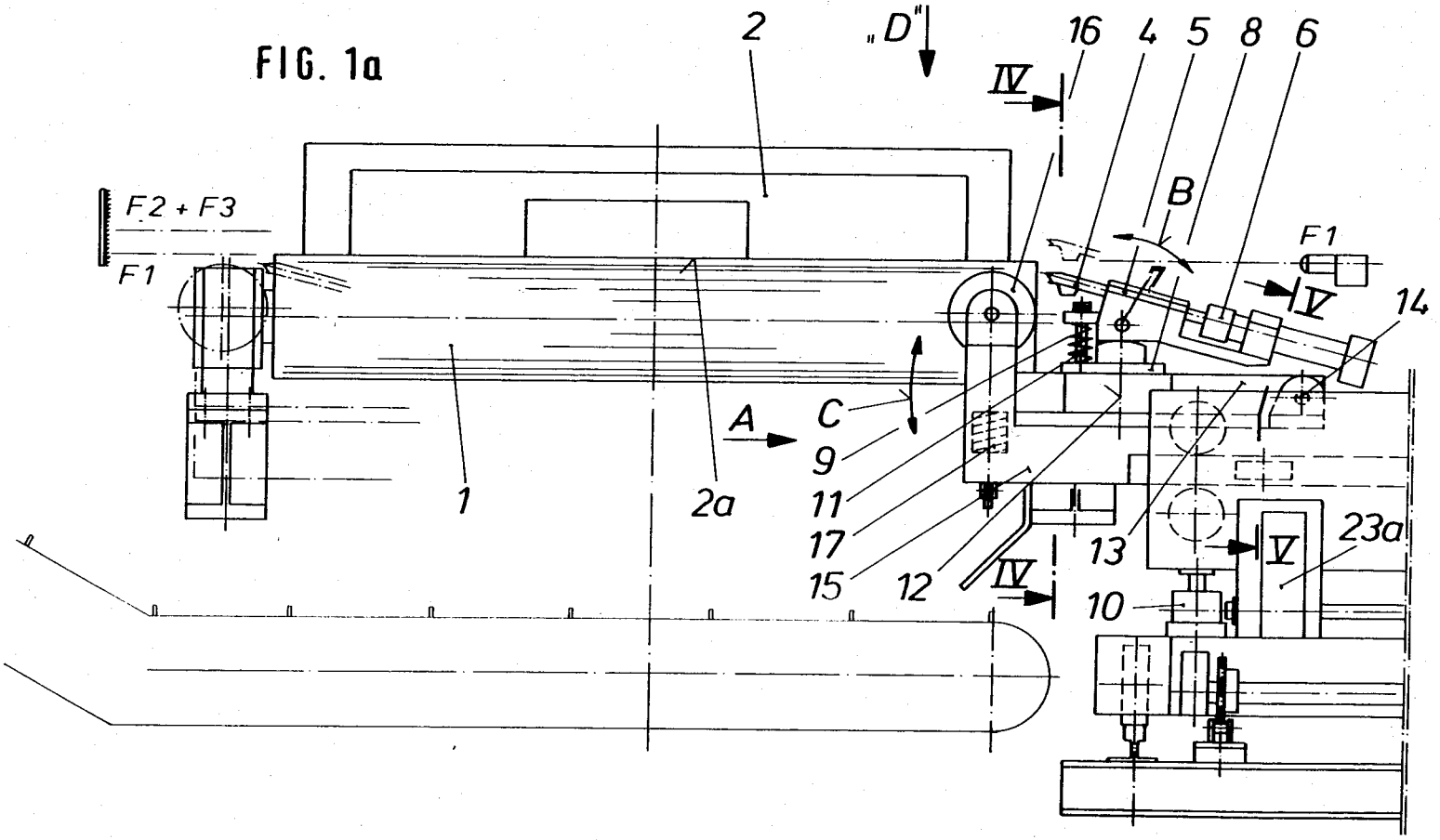
FIGS. 1*a* and 1*b* are parts of a general side elevational view of the appliance.

In FIG. 1*a*, differently sized slabs 2 are shown resting on roller 1 of a roller table. The slabs are flame-cut transversely or longitudinally causing formation of burrs 3 (FIG. 6) on the lower product surface 2*a*. The cutting tool used for removal of a burr is a flat chisel 4 moving at an angle to the product surface 2*a* and provided with a tapering chisel edge 4*a* (FIG. 6), the chisel being positioned to have the upper cone face 4*b* on chisel edge 4*a* run as parallel as possible to the product surface 2*a*. The chisel 4 is supported longitudinally in a chisel holder 5 which also carries the pulsating drive, i.e. a pneumatic percussion device 6.

In its inclination, i.e. transverse to the product surface 2*a*, the swivel holder 5 may be swivelled about a horizontal swivel axle 7 in the direction of arrow B. A preloaded spring 9 which may be replaced by any other resilient power means, is provided between the chisel holder 5 and a bearing block 8 supporting the swivel axle 7. Bearing block 8 may be raised and lowered, in the present example by a lifting device 10 which carries the entire substructure of the bearing block 8. A head-tipped spring bolt 11 extending through the inside of the preloaded pressure spring 9 is used for adjustment of the chisel holder 5 and, thus, of the flat chisel 4 to a gradient somewhat steeper than that shown in FIG. 6. On swiveling the chisel 4 slightly counter-clockwise (as viewed in FIGS. 1*a* and 6) and increasing the tension of pressure spring 9, the cone face 4*b* of the chisel edge 4*a* on chisel 4 will run exactly parallel to the product surface 2*a*. Chisel edge 4*a* is thereby positively prevented from cutting into the slab 2 or into the burr 3, but will actually peel off the burr. Such corrective adjustment commences at the beginning of a working cycle and is initiated by the raising motion of bearing block 8 and by contact of the chisel edge 4*a* with the product surface 2*a*.

Figure 2:
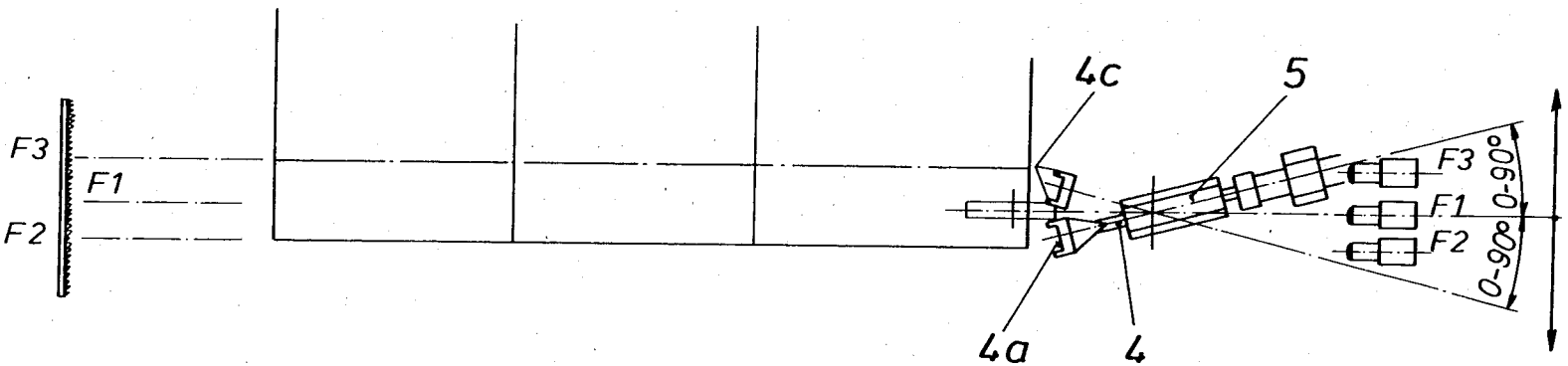
FIG. 2 is a top plan view of the chisel arrangement, to show its swivel movement.

Bearing block 8 may be swivelled about a vetical axle 12 as shown in FIG. 2. The swivel angles shown in the figure will permit the chisel edge 4*a* to be positioned somewhat slantingly to the longitudinal run of a burr to let it engage the burr from a side position. With a swivel angle of 90° in either direction from the center position shown in FIG. 2, flat chisel 4 may also be used for removal of a burr from a longitudinal cut extending transversely to the table roller 1. The chisel assembly must then of course be shifted to a position between two table rollers and removal of a burr is accomplished by advance motion of the roller table itself.

Figure 1B:
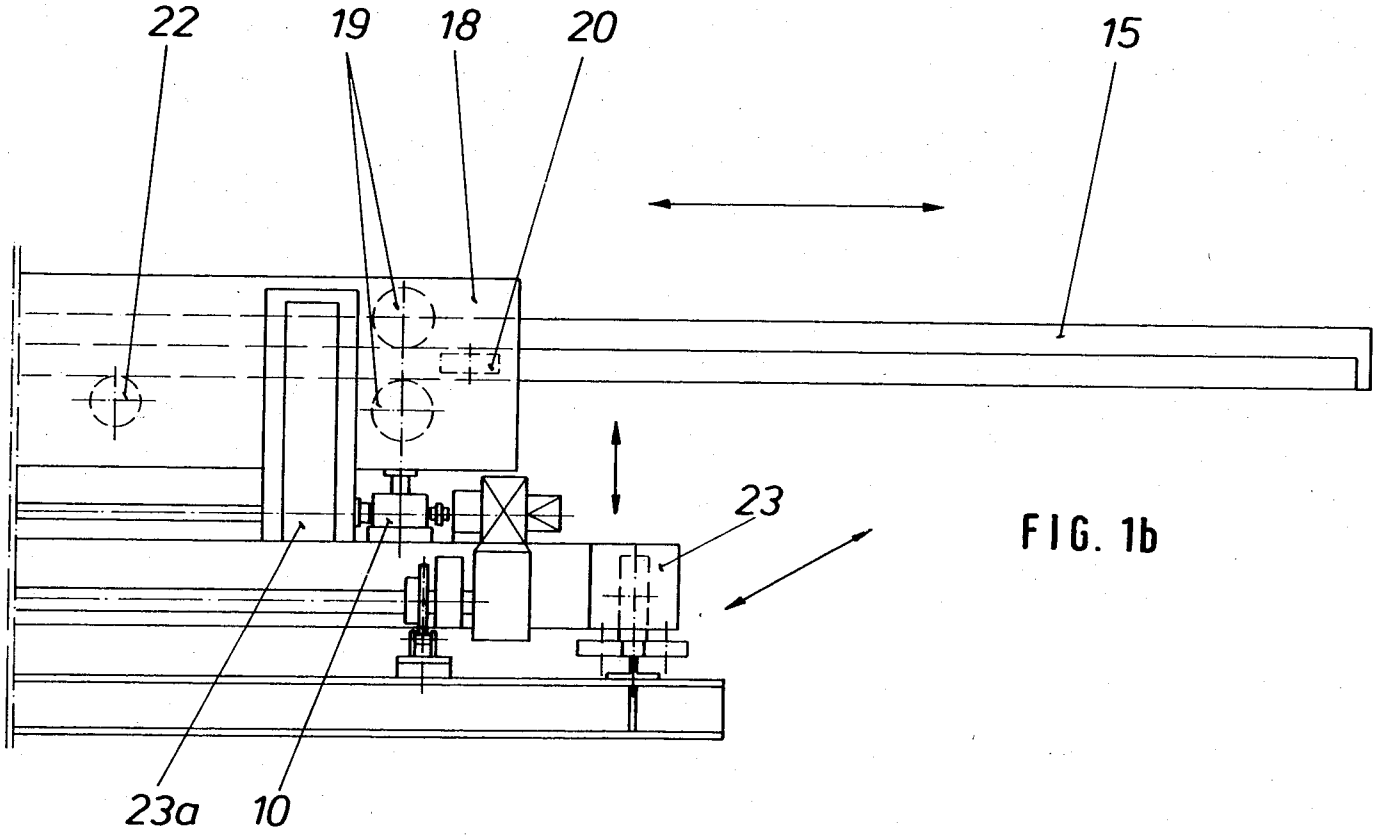
Figure 3:
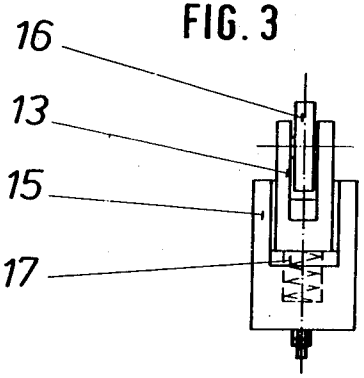
FIG. 3 is a partial elevational view taken in the direction of arrow A in FIG. 1*a;*
Figure 4:
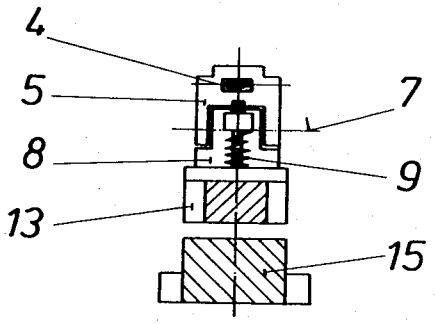
FIG. 4 is a vertical cross-sectional view taken along line IV—IV in FIG. 1*a*.

Bearing block 8 is supported in an intermediate member of rocker 13 type design, which may be slightly swivelled about the horizontal axle 14 of a guide beam 15. As may be seen in FIG. 1*b*, the supporting length of guide beam 15 corresponds to the horizontal stroke required for adjustment of the chisel assembly. Referring to the side view in FIG. 3, guide beam 15 has two walls extending upwardly for guidance of the rocker 13, the end section of the rocker located in front of the chisel edge 4*a* being designed to form a supporting cradle for a tracer roller 16. The free end of rocker 13 is seated on guide beam 15 through a spring 17. The function of the tracer roller 16 and the rocker 13 which may be swivelled in the direction of arrow C, will be described hereinafter. A vertically guided and resiliently supported slide may also be used as a substitute for rocker 13.

Figure 5:
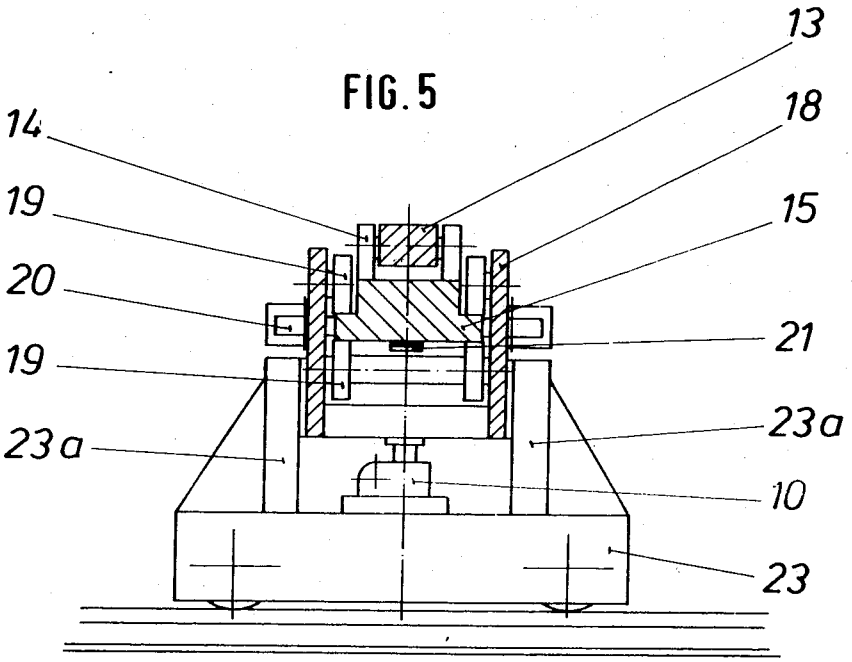
FIG. 5 is a cross-sectional view taken along line V—V in FIG. 1*a*, including a partial side view, but without the chisel arrangement.

The guide beam 15 and parts 4 to 14 and 17 supported thereon, are straight-guided in a guide frame 18 seated on the lifting device 10. The straight-guiding means of beam 15 comprises pairs of rollers 19 and rollers 20 having horizontal and vertical axles, respectfully, supported in the guide frame 18 (FIG. 5). For advance movement, guide beam 15 is provided with a rack 21 which meshes with a drive gear wheel 22. The reversible rotary drive for the drive wheel 22 is not shown. This would preferably be a variable speed drive with a continuously effective advance power, e.g. a pneumatic cylinder using a rack type piston rod, exerting continuous torque on the shaft of the drive gear wheel 22, or an electric rotary field magnet type drive.

With the straight-guide means provided for guide beam 15, the appliance of this invention is suitably equipped for removal of a burr on a product at rest. Such straight-guide means and advance drive are not required in cases where the appliance is designed stationary and where relative movement between the flat chisel and the semi-finished product is accomplished by movement of the product itself.

When the guide frame 18 is seated on a carriage 23 through the lifting device 10, the carriage being movable transversely to the guide beam 15 and being provided with side walls 23*a* for guidance of the guide frame 18, the entire appliance may be moved to a point outside the cutting line range of the flame cutter prior to a separating cut and may be quickly readjusted to the cutting line for burr removal in the still hot condition of the burr. However, the traverse drive of carriage 23 may also be utilized to advance the flat chisel for removal of burrs on a longitudinal or slitting cut.

On the other hand, this requires the use of a roller table with centrally subdivided rollers to prevent the parts located in the projection of the table rollers from fouling the rollers upon swivel movement of the chisel holder 5 with its chisel 4 and the pulsating drive 6. With the configuration of the roller table shown in the drawing, however, semi-finished product 2 is advanced to perform its relative movement, the flat chisel 4 being positioned between two table rollers and turned through 90°.

Figure 6:
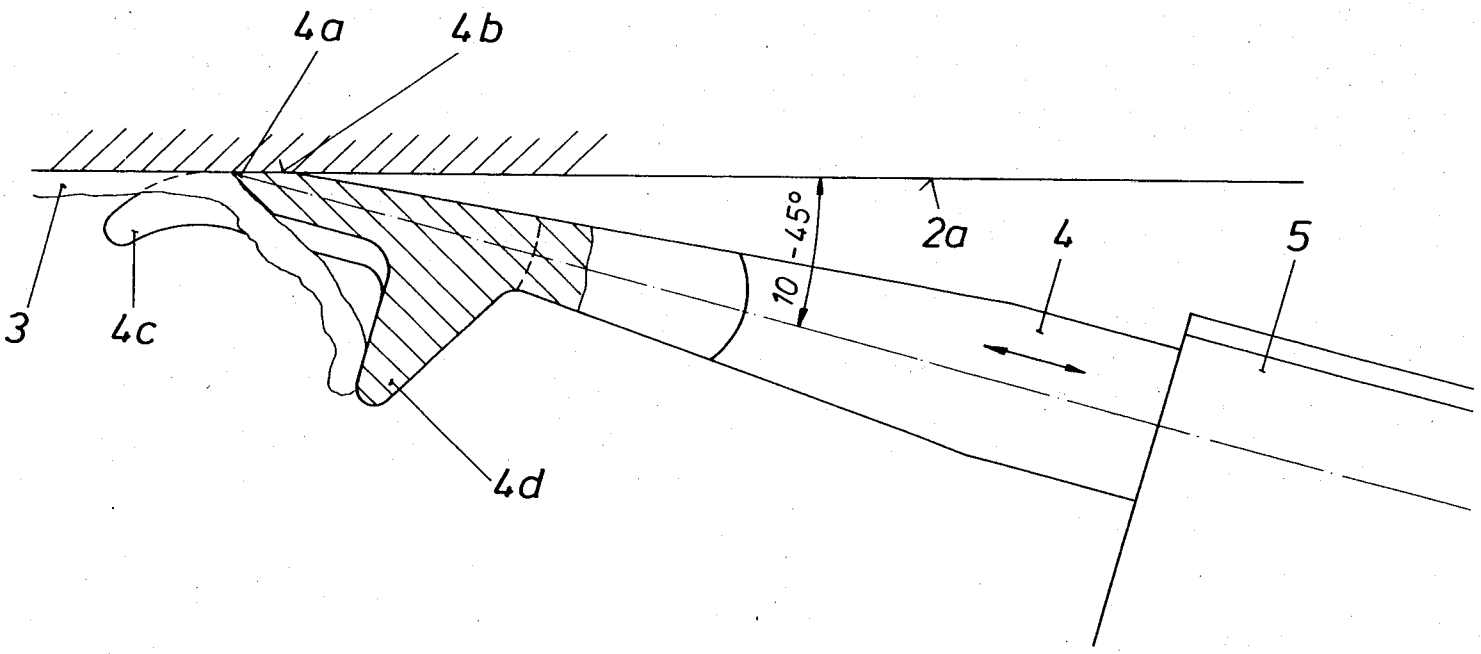
FIG. 6 is a partial cross-sectional view showing the configuration of the chisel nose on an enlarged scale.

The following functional description of the inventive equipment will more clearly explain the special design features of chisel 4 as shown in FIG. 6. In the situation depicted in FIGS. 1*a* and 1*b*, removal of a burr from a separating cut on the lower product surface 2*a* of the largest slab 2 is about to commence.

With the aid of spring bolt 11 and preloaded pressure spring 9, the gradient of chisel 4 has been adjusted to position chisel edge 4*a* at a level somewhat above the upper generating line of tracer roller 16 and to have the cone face 4*b* of chisel 4 still form a small angle with the product surface 2*a*. When the bearing block 8 or the entire substructure is raised through lifting device 10 and tracer roller 16 comes into contact with the product surface 2*a*, rocker 13 will swivel counter-clockwise in the direction of arrow C. Movement of the tracer roller against the product surface will cause a transmitter to transmit a signal to stop lifting movement, which will reduce said small angle between the cone face 4*b* of chisel 4 and the product surface 2*a*. The chisel tip is still outside the width range of the slab. When the drive for advance of guide beam 15 is started, chisel edge 4*a* will approach the onset of the burr. The last corrective adjustment of the gradient of chisel 4 to have the cone face 4*b* parallel to the product surface 2*a* is achieved by the particular shape of the chisel, in that at least one cutter face of the chisel is provided with a curved stop nose 4*c* projecting beyond the chisel edge 4*a* (FIG. 6), its curvature commencing at the chisel edge. Relative movement between the product and the chisel will cause said curved stop nose to come into contact with the product surface at a point beside the burr 3 for pre-adjustment of the level of the chisel edge 4*a* to the plane of the product surface 2*a*. As indicated in FIG. 2, flat chisel 4 is provided with two such stop noses 4*c* on either side of the chisel edge 4*a*. Consequently, on further advance of chisel 4, chisel edge 4*a* engage precisely between the product surface 2*a* and the burr 3, preferably with a horizontally positioned cone face 4*b*. In addition to the function described, the stop noses 4*c* will permit the chisel edge 4*a* to follow any camber that may be present on the semi-finished product. For this reason, the preferred method would be not to stop the lifting drive through the tracer control before the chisel edge reaches a position somewhat above the product surface 2*a*. More precisely, when the curved stop noses 4*c* come into contact with a side edge of the slab, they will force the chisel 4 to perform an additional swivel movement in the counter-clockwise direction. The chisel holder 5 will come clear of the head of spring bolt 11, thereby increasing the tension of spring 9, and the chisel edge will gain space to follow an upwardly cambered product surface 2*a*, i.e. to also work above the roller table level.

As further indicated in FIG. 6, the chisel edge 4*a* is provided with a protrusion 4*d* extending downwardly and spaced apart from chisel edge 4*a*, the function of which is to break up the loose portion of the burr 3 in the manner shown, for convenient burr disposal.

It should further be mentioned that vertical movement of the chisel edge 4*a* during the advancing procedure is also ensured by the swivel movements of rocker 13, i.e. when the tracer roller 16 moves over a cambered product surface.

I claim:

1. A burr cutting apparatus for removal of burrs on the surface of flame-cut slabs, blooms, billets and similar semi-finished products having a cutting tool adjustable in a vertical plane and movable relative to a semi-finished product and a cutting line, comprising:

a bearing block supported for raising and lowering thereof;

a cutting tool holder pivotably mounted on a horizontal axle on said bearing block for pivotal movement in a transverse direction relative to the product surface;

a flat chisel mounted on said cutting tool holder;

a pulsating drive means mounted on said cutting tool holder and operatively engageable with said flat chisel for driving said flat chisel in a pulsating manner;

a tapering chisel edge on said flat chisel;

resilient power means provided between said cutting tool holder and said bearing block for pivotally positioning said flat chisel at an angle relative to the product surface so that during operation raising said bearing block engages said chisel edge with and is continuously pressed against the product surface by the force of said resilient power means and increases said force; and means to move said cutting tool holder and product relatively to each other and parallel to the cutting line.

2. A burr cutting apparatus as claimed in claim 1 wherein:

said bearing block is mounted for rotation on a vertical axis.

3. A burr cutting apparatus as claimed in claim 1 and further comprising:

a raising and lowering means;

a guide beam supported on said raising and lowering means;

resilient power means on said guide beam;

an intermediate member supported on said guide beam resilient power means and having an end portion forward of said chisel edge in the cutting direction, said bearing block being supported on said intermediate member;

a supporting cradle on said end portion; and a tracer roller supported on said supporting cradle so that engagement of said tracer roller against the product surface will stop raising by said raising and lowering means at a position where said chisel edge is approximately at the working level.

4. A burr cutting apparatus as claimed in claim 2 and further comprising:

a raising and lowering means;

a guide beam supported on said raising and lowering means;

resilient power means on said guide beam;

an intermediate member supported on said guide beam resilient power means and having an end portion forward of said chisel edge in the cutting direction, said bearing block being supported on said intermediate member;

a supporting cradle on said end portion; and a tracer roller supported on said supporting cradle so that engagement of said tracer roller against the product surface will stop raising by said raising and lowering means at a position where said chisel edge is approximately at the working level.

5. A burr cutting apparatus as claimed in claim 3 wherein:

said intermediate member comprises a rocker pivotally mounted on a horizontal axis.

6. A burr cutting apparatus as claimed in claim 4 wherein:

said intermediate member comprises a rocker pivotally mounted on a horizontal axis.

7. A burr removing apparatus as claimed in claim 1 wherein:

said chisel edge has at least one chisel edge face provided with a curved stop nose projecting forwardly of said chisel edge, the curvature of said stop nose commencing at said chisel edge, so that relative movement between the semi-finished product and flat chisel allows said stop nose to engage the product surface at a position beside the burr for pre-adjusting the level of said chisel edge to substantially the plane of the product surface.

8. A burr removing apparatus as claimed in claim 6 wherein:

said chisel edge has at least one chisel edge face provided with a curved stop nose projecting forwardly of said chisel edge, the curvature of said stop nose commencing at said chisel edge, so that relative movement between the semi-finished product and flat chisel allows said stop nose to engage the product surface at a position beside the burr for pre-adjusting the level of said chisel edge to substantially the plane of the product surface.

9. A burr cutting apparatus as claimed in claim 1 and further comprising:

a protrusion on said flat chisel spaced from said chisel edge in a position for breaking up the loose portion of the burr cut off by said chisel edge.

10. A burr cutting apparatus as claimed in claim 8 and further comprising:

a protrusion on said flat chisel spaced from said chisel edge in a position for breaking up the loose portion of the burr cut off by said chisel edge.

11. The apparatus as claimed in claim 3 wherein said means to move said cutting tool holder and product relatively to each other comprises:

a guide frame mounted on said raising and lowering means to be raised and lowered thereby; and guide rollers rotatably mounted on said guide frame operatively supporting and guiding said guide beam for movement relative to said guide frame.

12. The apparatus as claimed in claim 10 wherein said means to move said cutting tool holder and product relatively to each other comprises:

a guide frame mounted on said raising and lowering means to be raised and lowered thereby; and guide rollers rotatably mounted on said guide frame operatively supporting and guiding said guide beam for movement relative to said guide frame.

13. A burr cutting apparatus as claimed in claim 11 and further comprising:

a gear rack on said guide beam; and a drive gear wheel rotatably mounted on said guide frame in meshing engagement with said gear rack.

14. A burr cutting apparatus as claimed in claim 12 and further comprising:

a gear rack on said guide beam; and a drive gear wheel rotatably mounted on said guide frame in meshing engagement with said gear rack.

15. A burr cutting apparatus as claimed in claim 11 and further comprising:

a carriage movably mounted for movement transversely to the direction of movement of said guide beam, said raising and lowering means being supported on said carriage for movement therewith.

16. A burr cutting apparatus as claimed in claim 14 and further comprising:

a carriage movably mounted for movement transversely to the direction of movement of said guide beam, said raising and lowering means being supported on said carriage for movement therewith.

17. A burr cutting apparatus as claimed in claim 1 wherein said means to move said cutting tool holder and product relatively to each other comprises:

variable speed control means adapted for increasing the speed of said flat chisel in the cutting direction as the cutting load decreases and vice versa.

18. A burr cutting apparatus as claimed in claim 16 wherein said means to move said cutting tool holder and product relatively to each other comprises:

variable speed control means adapted for increasing the speed of said flat chisel in the cutting direction as the cutting load decreases and vice versa.

* * * * *